US005191375A

United States Patent [19]

Hamilton

[11] Patent Number: 5,191,375

[45] Date of Patent: Mar. 2, 1993

[54] FUSER LOW POWER CONTROL

[75] Inventor: Douglas C. Hamilton, Lexington, Ky.

[73] Assignee: Lexmark International, Inc., Greenwich, Conn.

[21] Appl. No.: 835,873

[22] Filed: Feb. 14, 1992

[51] Int. Cl.[5] ..... G03G 21/00

[52] U.S. Cl. ..... 355/205; 219/216; 355/285

[58] Field of Search ..... 355/282, 285, 207, 205; 219/216, 469–471

[56] References Cited

U.S. PATENT DOCUMENTS 4,540,274 9/1985 Abuyama ..... 219/216 X 4,618,242 10/1986 Yamagishi ..... 355/282

4,668,073 3/1987 Hatabe et al. ..... 355/282 X

*Primary Examiner*—A. T. Grimley

*Assistant Examiner*—Shuk Y. Lee

*Attorney, Agent, or Firm*—John A. Brady

[57] ABSTRACT

Fixing of images by fuser roller (3) in printer (1) is delayed by control of paper feed clutch (7) when abnormally low power is determined during an earlier cold start or start from standby. Sensed temperature values from thermistor (9) are compared with predetermined value in comparator (15) under control of microprocessor (14). When the time period for heating is longer than a predetermined time, subsequent activation of the clutch is briefly delayed.

4 Claims, 1 Drawing Sheet

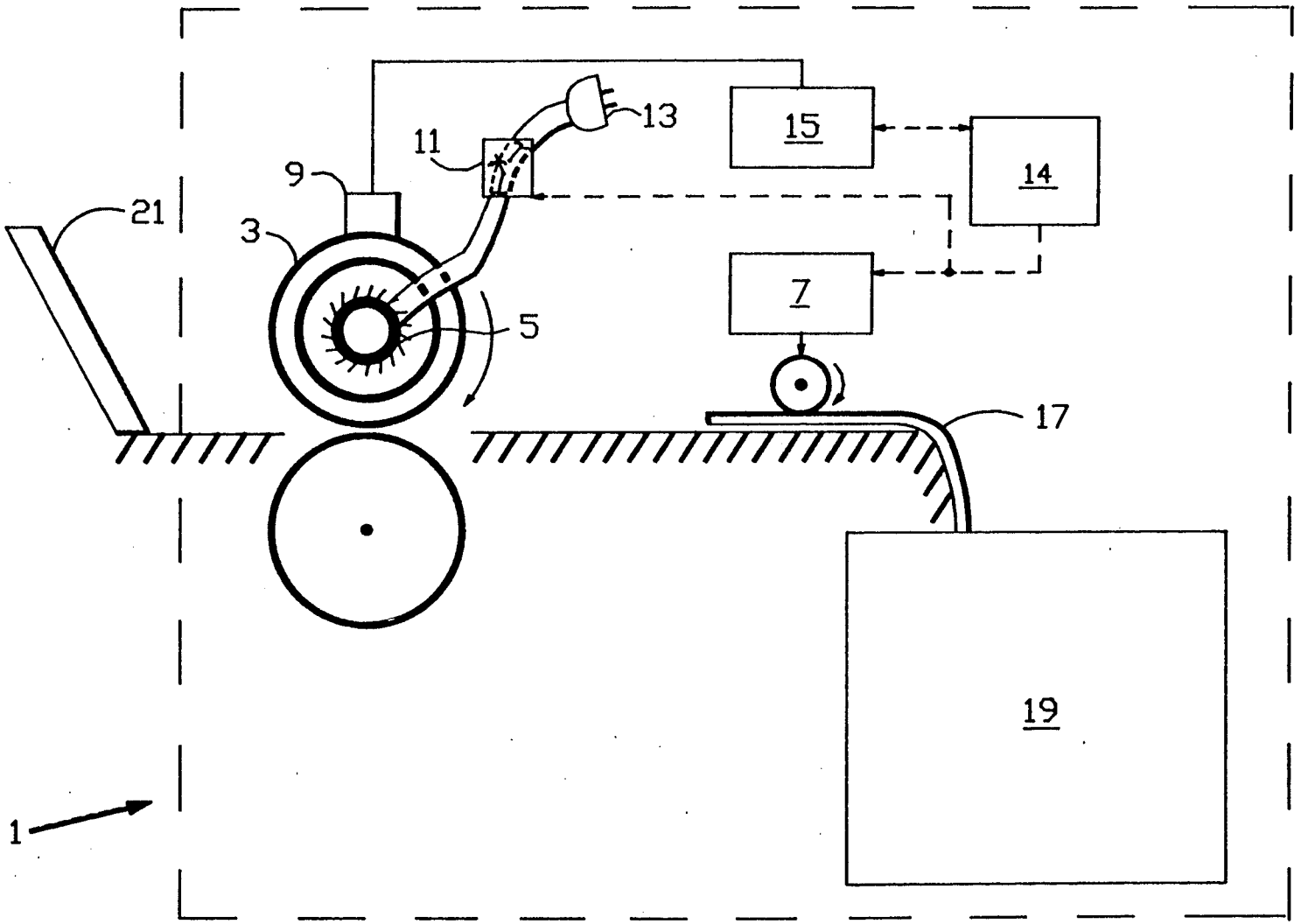
14
15
7
13
11
9
3
5
17
19
21
1

FUSER LOW POWER CONTROL

DESCRIPTION

Technical Field

This invention relates to system control for the fusing operation of toner images. In electrophotographic and similar imaging systems toner is applied in a loose form and is fixed in place with heat. The fusing iron, typically a roller of organic material, must be at a predetermined high temperature to adequately function, and, when electrical power to the fusing iron is low, the fusing iron may not be at the designed temperature at the time assumed by the overall design of the imaging system. This invention provides control to assure adequate temperature of the fusing iron.

Background of the Invention

Proper fusing temperature is essential to both adequate fixing of the image and avoiding detrimental effects of too high temperature. Too high temperature can damage components as well as the final image, and require excessive cooling resources. It is conventional to have a temperature sensor on the fusing iron, typically a roller, to measure the temperature for overall system control. Control systems may be elaborate to compensate for delays in response to activating and deactivating a heating element which functions to heat the fusing iron.

The rate of change of fuser roller temperature is directly proportional to the energy applied to typical heaters, such as a quartz halogen lamp located inside a fuser roller. Increasing the designed power to the halogen lamp to avoid defective operation when input voltage is low results in excessive power drain on the overall electrical system, which may affect room lights and other appliances. Increasing the standby temperature is limited by the temperature tolerance of other components of the imaging system, which typically are kept near their practical limit. Thus, increased standby temperature would require increased system cooling, normally obtained by increasing the capacity of an internal fan, which increases noise and overall cost.

Imaging system design can be slowed to provide time for fuser heating even at seriously deficient power input to the fuser. Such delay affecting all operations is clearly undesirable.

DISCLOSURE OF THE INVENTION

The preferred embodiment of this invention employs such a conventional sensor and turns off and on an internal quartz halogen lamp which is the heating element for a fuser roller. The imaging control system is designed for a voltage to the halogen lamp at least at a predetermined level, and a paper to be fixed moves toward the fuser roller at a predetermined time which provides adequate heating time when the voltage is at the predetermined level.

In accordance with this invention, the time of fixing the image is controlled by a system which has monitored the heating response of the fuser iron. Typically, this response will be slow when the input voltage to the heating element is low. Normal response information is stored in electronic memory of data processing apparatus associated with the imaging system. At some point at which the fuser temperature is low, such as at cold start or after standby, fuser heating is activated and fuser temperature is monitored by the existing system to sense when it reaches a starting temperature with respect to the stored normal response. At that point timing measurement is begun using standard clocking of the data processing apparatus. Fuser temperature is monitored to sense when it reaches an ending temperature with respect to the stored normal response. When the time to reach that response is more than normal as defined by the stored normal response information, the initiation of the start of a future fusing operation is delayed during further imaging so that the fuser iron can reach the desired temperature. In this manner, system response is at full designed speed where the fuser operation is normal and is slowed only when fuser heating is slower than normal. Such slower fuser operation will occur where input voltage is lower than rated, a typical problem in certain geographic areas.

The preferred embodiment is a printer, but this invention is believed to be applicable virtually without modification to a copier having fixing by fusing iron.

BRIEF DESCRIPTION OF THE DRAWING

The details of this invention will be described in connection with the accompanying drawing, which illustrates symbolically imaging apparatus implementing this invention.

BEST MODE FOR CARRYING OUT THE INVENTION

The invention solves the problem of the fuser not reaching the required hot roll temperature for acceptable fusing of the toner without requiring an increased power halogen lamp or other heater. The problem occurs when the power line voltage is below 104 volts AC for nominally 115 volts AC line voltage or below 199 volts AC for nominally 220 volts AC line voltage. At these power line voltages the heat energy from the halogen lamp is not sufficient to raise the surface temperature of the hot fuser roller from the standby temperature to the desired value in the allowed time. Increasing the capacity of the halogen lamp to solve this problem may result in lights connected to the same power line blinking when the printer is turned on. Increasing the standby temperature is limited by the combination of temperature limits of other components, specifically a motor to rotate a mirror in the optical system of a laser printer, and by the acceptable noise level of the fan in the imaging device in the standby mode.

This embodiment uses the existing capabilities of the printer 1 to measure fuser roller 3 temperature. During a cold start (printer power is turned from off to on) the elapsed time between the fuser roller 3 temperature being at 70 degrees C. and being at 165 degrees C. is measured. This time is used to determine if the power line voltage applied to the fuser lamp 5 is below the minimum acceptable value (either 104 volts AC or 199 volts AC) needed in normal operation for the fuser to reach the proper fusing temperature before paper enters the fuser.

If the power line voltage is determined to be below the acceptable value, a clutch 7 which activates the paper feed is not picked until the fuser roller 3 has had sufficient time to reach a temperature, called the starting temperature (170 degree C. in this embodiment), that is above the standby temperature. This starting temperature is selected to be such that, for power line voltages below the minimum acceptable value (either 104 volts AC or 199 volts AC) but equal to or above the minimum power line voltage that the system was designed to operate under, the fuser roller 3 will reach the desired temperature to fix the toner during the elapsed time from picking the clutch 7 and the paper entering the fuser. In the preferred application in a laser printer 1, this delay in activating clutch 7 can add an additional 1 second maximum to the time it takes the first page to exit the printer.

The heating element is a quartz halogen lamp 5 which is stationary in position, and the fusing iron is a roller 3 which contains the halogen lamp and turns around it. The surface of roller 3 is typically a hard rubber, a polytetrafluoroethylene resin coating or a similar coating material. The halogen lamp 5 converts AC electrical energy to radiant heat energy which is absorbed by the fuser roller 3 to cause the surface temperature of the fuser roller to be heated. Standby temperature after power on is 165 degrees. Fusing temperature typically is 20 to 30 degrees higher, depending on the specific characteristics of the toner.

The existing temperature sensor 9 is used, which may be a thermocouple or thermistor in contact with the fuser roller surface. This produces an electric voltage proportional in a known amount to the temperature of the fuser roller. A simple switch 11 is controlled to either apply line voltage from a standard wall plug 13 to the halogen lamp 5 when the switch is closed or deny any such electrical voltage when the switch is open. The level of heat from the halogen lamp 5 varies directly as an exponential function of the effective level of line voltage applied to it.

Implementation of this invention uses standard data processing techniques which will therefore not be elaborated upon. The printer has a general-purpose microprocessor 14 as part of its system control, as is now conventional and well understood. The elapsed time is determined between the fuser hot roller surface temperature of 70 degrees C. and 165 degrees C. (the standby temperature) during a cold start. Sensing is by sensor 9 and the level sensed is an input to comparator/digital to analogue converter 15. Microprocessor 14 performs the following operations using program routines which may be entirely straightforward since the functions described are widely practiced in computer applications.

At power on microprocessor 14 writes an 8 bit value to comparator/digital to analogue circuit 15. The digital to analogue system of circuit 15 transforms the 8 bit value to a corresponding voltage level in a conventional manner, and the comparator system of circuit 15 employs that voltage level as a reference level to compare with the sensed voltage from the fuser roller temperature sensor 9. The 8 bit value is that found by experiment during machine design to be that which is transformed by the digital to analogue circuit 15 to a level matching that produced by sensor 9 when the sensor 9 senses 70 degrees C. The comparator 15 changes logic level when the surface of roller 3 produces a signal matching the reference voltage, indicating the surface has reached 70 degrees C.

That status of the comparator 15 is monitored by microprocessor 14, which starts timing when the level at reaching 70 degrees C. is set. Microprocessor 14 again writes an 8 bit code to the comparator/digital to analogue circuit 15, this code being representative of a temperature of 165 degrees C. The value is similarly found by experiment during machine design. In this manner the comparator/digital to analogue circuit 15 changes logic level when the surface of roller 3 reaches 165 degrees C. This change in logic level is monitored by the microprocessor 14, which observes and stores the time expired from the start at 70 degrees.

The stored time period, represented in a binary code in microprocessor 14, is compared with stored codes determined by experiment during machine design as indicative of temperature rise with the desired timing.

Where the code is indicative of deficient heating, equivalent to less that 104 volts AC for nominal 115 volts AC line voltage or less than 199 volts AC for nominal 220 volts AC line voltage, the image fixing operation is delayed one second by microprocessor 14 by delaying the activation of a paper feed clutch 7 which starts the fusing operation. This delay continues until the next cold start, where it will be reinstituted as discussed above if heating is again deficient.

Upon activation of clutch 7, paper or other image substrate 17 imaged with loose toner in imaging system 19 is fed to fuser roller 3, where heat and moderate pressure coalesce the toner and thereby fix it to paper 17, as is standard. Paper 17 is then delivered to an output tray 21, as is standard.

As an alternative, the monitoring may be from standby temperature to fusing temperature or some other temperature selected for the purpose. With monitoring from standby, the control could be effected periodically, rather than only during a cold start. However, the accuracy of the digital to analogue circuit 15 becomes a greater factor, and therefore overall accuracy is impaired. Other alternatives will be apparently or devised which are within the spirit and scope of this invention.

I claim:

1. Imaging apparatus comprising an imaging system creating images in loose toner on a substrate, a heating iron to fix such loose toner by applying heat, a heating element to heat said heating iron, means to measure the temperature of said heating iron, means to activate said heating element and to then measure the time period between when said means to measure represents a first predetermined temperature and when said means to measure represents a second predetermined temperature, and means to extend the period between start after standby and the initial feeding of said substrate after start to said heating iron when said measured time period is greater than a predetermined amount.

2. The imaging apparatus as in claim 1 in which said heating iron is a rotatable roller and said heating element is a quartz halogen lamp stationary in position within said roller.

3. The imaging apparatus as in claim 2 in which said means to measure the time period is activated at a cold start of said imaging apparatus.

4. The imaging apparatus as in claim 1 in which said means to measure the time period is activated at a cold start of said imaging apparatus.

* * * * *